United States Patent [19]

Braden et al.

[11] 4,220,266

[45] Sep. 2, 1980

[54] ICE DOOR DELAY MECHANISM

[75] Inventors: Ralph S. Braden, Bellbrook; Louis D. Benasutti, Fairborn; Jerry L. Neubauer, Dayton, all of Ohio

[73] Assignee: White Consolidated Industries, Inc., Cleveland, Ohio

[21] Appl. No.: 946,504

[22] Filed: Sep. 28, 1978

[51] Int. Cl.[2] ..... E05F 5/06; F25C 5/18

[52] U.S. Cl. ..... 222/477; 49/30; 16/84; 62/344

[58] Field of Search ..... 222/477, 70; 49/30; 62/344; 16/84; 292/DIG. 28

[56] References Cited

U.S. PATENT DOCUMENTS

| | | | |
|---|---|---|---|
| 3,042,958 | 7/1962 | Spears | 16/84 |
| 3,182,857 | 5/1965 | Bischoff et al. | 222/477 X |
| 3,459,343 | 8/1969 | Rasmussen | 222/477 |
| 3,789,620 | 2/1974 | Benasutti et al. | 222/456 X |
| 4,053,961 | 10/1977 | Wilson et al. | 16/84 |
| 4,102,660 | 7/1978 | Beckett et al. | 62/344 |

*Primary Examiner*—F. J. Bartuska

*Attorney, Agent, or Firm*—Pearne, Gordon, Sessions

[57] ABSTRACT

A refrigerator freezer door has an ice service area in its outer face including an actuator for opening a passage closure member. Upon depressing the actuator a switch is closed to energize a power driven ice dispenser in the freezer compartment which discharges ice pieces down a chute and into the passage through the freezer door to the service area. A suction cup positioned on the actuator has an air bleed passageway to delay return movement of the actuator and closing of the closure member until the chute has emptied its ice pieces into the passageway.

1 Claim, 9 Drawing Figures

ICE DOOR DELAY MECHANISM

This invention relates to ice piece dispensers for domestic refrigerators and more particularly to an apparatus for energizing the dispenser and delaying the closing of a passage through an opening in the wall of the refrigerator.

In present day household refrigerators having automatic ice makers a popular option is to provide thru-the-door ice piece dispensers for delivering "ice cubes" to an exterior service area in the front of the door. One form of an ice door mechanism is disclosed in U.S. Pat. No. 3,789,620 issued Feb. 4, 1974 to L. D. Benasutti and J. S. Sucro, wherein the ice maker is located in the freezer compartment of a top freezer refrigerator while the exterior surface area is located in the front of the lower fresh food compartment door. The present invention relates to a delay mechanism for a closure member used to seal the ice drop passage in the refrigerator cabinet. The present application relates to a side-by-side domestic refrigerator having an automatic ice maker in the freezer compartment while the exterior ice service area is located in the front of the freezer door. The ice pieces are dispensed from a storage bin and fall by gravity through the door passage and into the service area for collection in a suitable container by the operator.

In such ice dispensing arrangements it is necessary that a closure member be provided to seal the passageway whereby it is only open during a nominal time interval sufficient to allow all the ice being dispensed from the ice storage bin to travel through the passageway into the service area. The above-mentioned Benasutti et al patent disclosed one type of delay mechanism for a closure member which provides that bellows members are compressed responsive to the inward movement of an actuator. After the release of the actuator, air is bled back into the bellows through inlet port means allowing the bellows to slowely expand under influence of a gravity biased closure arrangement resulting in the delayed closing of the ice passageway.

It is an object of the present invention to provide an improved delayed closure member for an ice piece dispensing apparatus wherein the closure member is normally biased to seal a passageway in a refrigerator cabinet. An actuator is operative for moving the closure member from its biased closed position to an open position permitting ice pieces dispensed from an icemaker apparatus to enter the passageway opening within the cabinet. The means for delaying the return of the closure member to its sealed position include a suction cup structure positioned on the actuator having a suction cup of resilient material arranged whereby upon the actuator being manually moved to its innermost position the suction face engages a planar surface in the service area while an actuator arm member closes a switch to energize the ice dispensing apparatus. Upon release of the actuator the suction cup is operative to resiliently move the actuator outwardly to a predetermined time delay position retained by the suction gripping engagement between the cup and the surface while the arm member is retracted from its switch contacting position allowing the switch to open and deenergize the icemaking dispensing apparatus. The actuator is retained in the time delay position for a predetermined interval to prevent the closing of the closure means thereby insuring that all the dispensed ice pieces have passed through the passageway opening. With the completion of the time delay period sufficient air is bled into the suction cup to destroy the suction therein allowing the actuator to return to its biased outer position as a result of the closure member being returned by gravity to its closed position.

Further objects and advantages of the present invention will become more apparent from the following specification, reference being had to the accompanying drawings of which:

Figure 1:
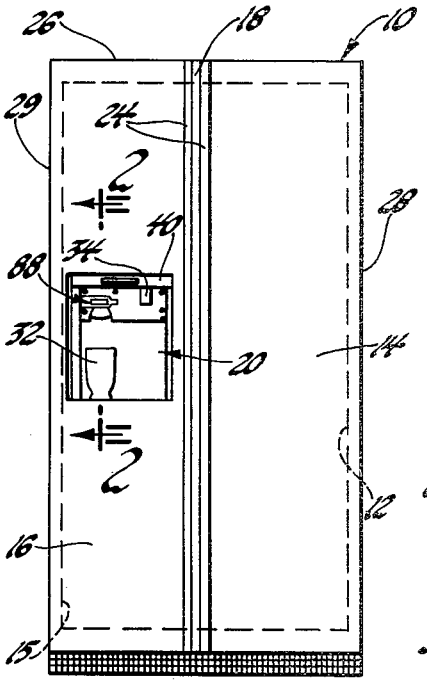
FIG. 1 is a front elevational view of a side-by-side refrigerator incorporating the present invention.

Referring now to the drawings, especially FIG. 1, there is shown a refrigerator cabinet 10 generally referred to as a side-by-side refrigerator having a fresh food compartment 12 closed by righthand access door 14 and a freezer compartment 15 closed by lefthand door 16, separated by a vertically disposed insulating partition 18. In the disclosed embodiment an ice recessed service area 20 is provided in the face of the freezer door 16. The cabinet doors include door handles 24 while an outer metal shell provides an insulated top outer wall 26, a back wall (not shown) and side walls 28, 29.

In the disclosed embodiment the service area 20 includes a housing member 30, preferably formed of plastic material located in the door 16 defining the area 20 such that a suitable receptacle such as a drinking glass 32 may be positioned on the shelf of the service area for receiving ice pieces by depressing an actuator to be described. As the present invention relates only to the ice piece dispensing portion of the service area, the details of the water dispensing arrangement will not be discussed. Suffice it to say that by depressing actuator 34 chilled water is dispensed. In this regard reference may be had to U.S. Pat. No 4,036,620 to Benasutti, et al, issued July 19, 1977 and assigned to the assignee of the present application for a disclosure of a portion of a water dispensing means including a water chilling tank for such a refrigerator.

Figure 2:
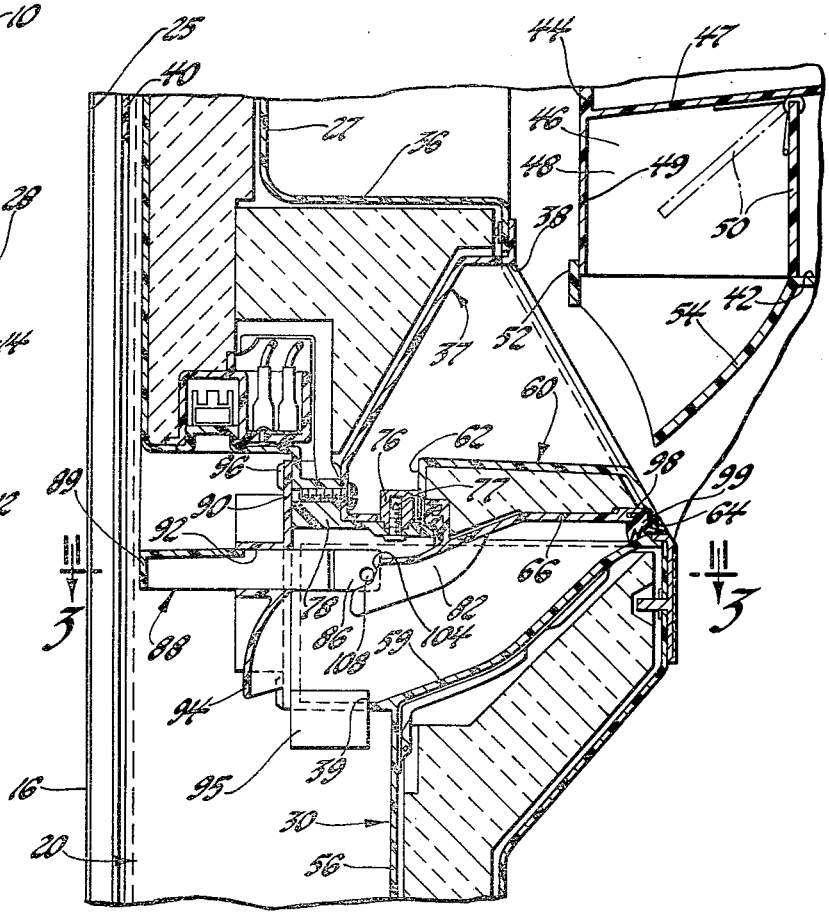
FIG. 2 is an enlarged fragmentary vertical sectional view, taken generally along the line 2—2 of FIG. 1.

As seen in FIG. 2, the freezer door 16 includes an outer sheet metal wall 25 while the inner wall of the door is provided with a door pan 27 of suitable sheet plastic material. The inside of the door 16 includes an enclosure 36 located substantially coextensive with the service area defining an opening receiving a forwardly inclined cabinet delivery chute 37 defining an inner opening 38 through which ice pieces may be dispensed through outer lower exit 39.

The refrigerator cabinet includes a suitable cooling system such as an air flow cooling arrangement as disclosed in U.S. Pat. No. 3,893,307 to Jacobs and assigned to the same assignee as the present application.

FIG. 1 shows a vertical sliding closure panel 40 for the freezer door service area in its raised position allowing access to the service area. For details of one type of such a sliding closure panel, reference may be had to U.S. Pat. No. 4,046,438 issued to Benasutti et al and assigned to the same assignee as the present application for details of one such closure panel.

As seen in FIG. 2, an exit opening 42 of an ice storage container is located at the forward end portion of an ice piece dispenser arrangement the housing of which is partially indicated at 44. The dispenser housing member 44 includes an ice piece discharge compartment 46 defined by an upper wall 47 and opposed side partitions, one of which is shown at 48 and a front baffle wall 49. For details of one such ice dispensing device and storage bin arrangement reference may be had to U.S. Pat. No. 3,887,119 issued to J. Sucro et al on June 3, 1975 and assigned to the assignee of the present application which discloses one type of ice dispensing device suitable with the present invention.

As disclosed in the Sucro patent, a reciprocating ram (not shown) is operated to advance the ice pieces to the front of the dispenser housing 44 and against pivoted closure means in the form of a trap door 50 pivotally mounted at the entrance to the ice piece discharge housing member 46. The trap door 50 is normally biased closed by suitable spring means whereby the trap door 50 is allowed to pivot outwardly to an open position, indicated by dashed lines in FIG. 2, upon the ice pieces being advanced there-against by the ram as explained in detail in the Sucro et al patent 3,887,119. It will be noted in the disclosed form that the discharge compartment 46 is positioned at a location adjacent the entrance 38 of delivery chute 37. A ramp member 52, having an arcuate shaped trough 54, receives the ice pieces as they fall from the compartment 46 and thence through the opening 38 into the delivery chute 37. The delivery chute 37 defines a passageway 59 which extends from the inner surface of enclosure 36 and the rear wall 56 of the service area for conveying ice pieces discharged from the dispenser housing 44 to the service area 20.

Figure 8:
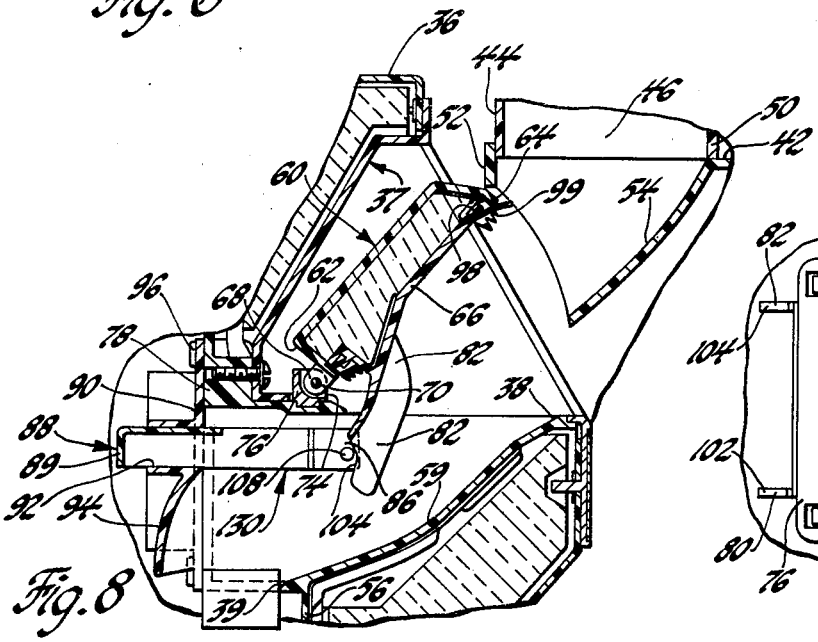
FIG. 8 is a view taken substantially on the line 8—8 of FIG. 4 showing the closure member in its fully raised and open position.
Figure 9:
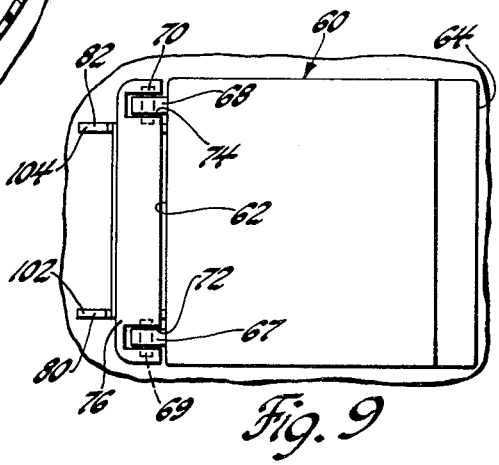
FIG. 9 is an enlarged, fragmentary top elevational view of the closure member showing its pivotal connection.

With reference to FIGS. 2 and 8, passageway 59 is provided with closure means in the form of an insulated closure member 60 operable when in its horizontal closed position (FIG. 2) to close in a sealed manner the entrance opening 38 of the passageway.

The upper wall of the closure member 60 is shown as sheet plastic having downwardly formed front 62 and rear 64 flanges receiving the edges of a bottom panel 66 formed preferably of plastic material. The front flange 62 has hinge means in the form of a pair of forwardly extending spaced ears 67 and 68 provided with aligned apertures for receiving transverse pin members 69 and 70, the outer ends of which are fixedly received in slots 72, 74 of hinge bracket 76. As seen in FIG. 2, the hinge bracket 76 is secured as by screws 77 to support member 78. The closure member 60 hinge means thus allows the closure member to swing or pivot to an upwardly and rearwardly inclined position, shown in FIG. 8, where it clears the passageway 59 for the reception of ice pieces from the dispenser 44.

The closure member 60 actuating means includes a pair of longitudinally extending arcuate ribs 80 and 82 integrally formed on either side of its bottom panel positioned in the passageway 59 so as to project forwardly beyond the rear wall 56 of the service area for pivotal attachment to spaced parallel legs 84, 86 of a U-shaped actuator 88 movably supported in service area face plate 90. The U-shaped actuator 88, which includes an operating bight portion or bar 89 connecting the spaced parallel legs 84 and 86, is slidably received for reciprocal movement in a rectangularly shaped conforming aperture 92 formed in the cover or face plate 90. A downwardly extending outwardly convex deflector portion 94 integral with the face plate and side guides 95 serve to channel ice pieces vertically downwardly into the service area through the exit 39 of the passageway. The face plate 90, secured by screws 96 to support 78, serves additionally to provide a decorative finish for the service area, including suitable nomenclature thereon to identify the actuator 88.

Each arcuate rib 80, 82 has a notched-out portion 102, 104 respectively, formed in its upper edge for receiving transversely projecting studs 106, 108 integrally formed on the inner surface of the actuator legs 84, 86. In this way opening of the closure member 60 is achieved about pins 69 and 70 resulting in the pivotal movement of closure member 60 to its position of FIG. 8 upon the user pushing in on the actuator bar to its position shown in FIG. 4.

As seen in FIGS. 2 and 8, the closure member 60 bottom panel 66 peripheral edges are formed with an outwardly facing molded slot 98 for reception of a flexible gasket 99 providing a substantially airtight seal for the chute opening 38, when the closure member is in its horizontal closed position.

Figure 4:
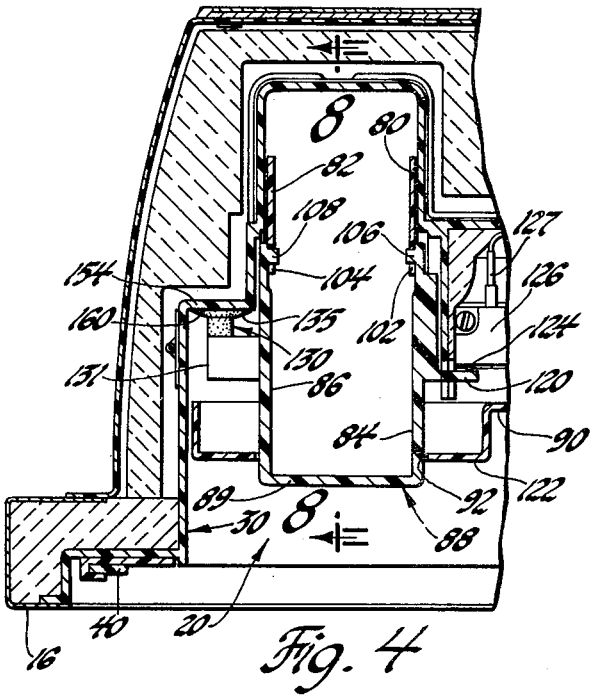
FIG. 4 is a fragmentary vertical sectional view of the left hand portion of FIG. 3, showing the actuator in its furthermost depressed position.

With reference to FIG. 4, it will be seen that upon full inward travel of the actuator 88, pivotal movement between the arcuate ribs 80, 82 and their associated actuator leg studs 106, 108 is achieved resulting in the movement of the closure member to its upwardly and rearwardly inclined open position. It will be noted that the right hand leg 84 of the actuator 88 includes a transversely extending arm 120 which in the disclosed form is integrally formed with the actuator leg. The arm 120 positioned such that with the actuator 88 in its normal outward position arm 120 is located adjacent the forwardly offset portion 122 of the face plate 90 limiting the outward travel of the actuator. Upon the actuator 88 being pushed fully inward (FIG. 4), the arm 120 is positioned such that it contacts and depresses a plunger or actuator button 124 of switch means in the form of a microswitch 126 suitably secured in the service area behind the face plate 90. The microswitch is electrically connected by conductors 127 and 128 such that when the button 124 is depressed it closes a circuit to energize an electrical drive motor (not shown) of the ice dispenser 44 in a manner disclosed in the aforementioned Sucro U.S. Pat. No. 3,887,119. The ice dispenser 44 will deliver ice pieces via the trough 54 into the chute opening 38 upon the closure attaining its inclined position of FIG. 8.

Figure 3:
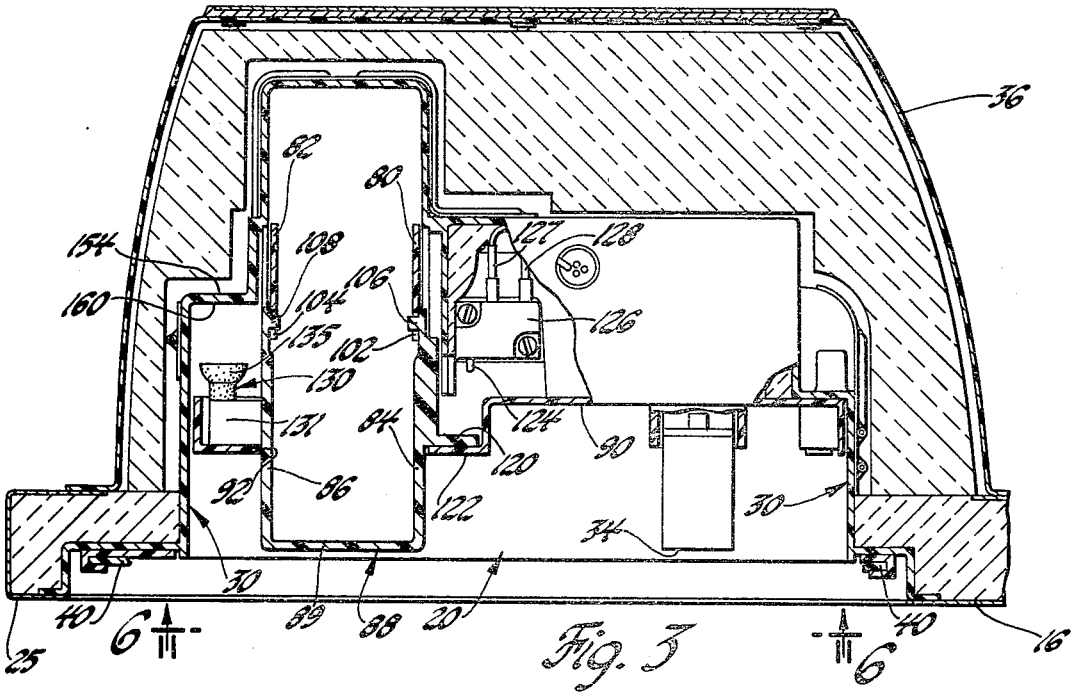
FIG. 3 is a top elevational view taken substantially long the line 3—3 of FIG. 2.
Figure 6:
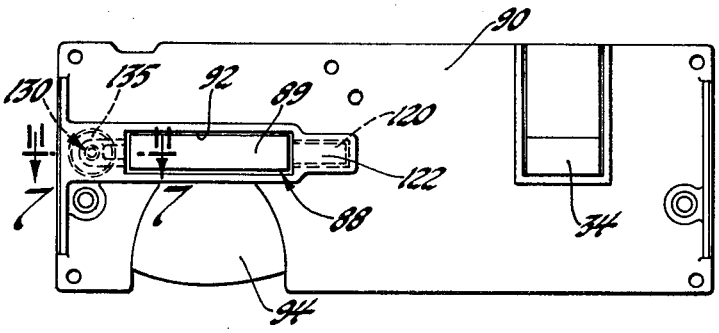
FIG. 6 is an enlarged front elevational view of the upper portion of the service area taken substantially on the line 6—6 of FIG. 3.
Figure 7:
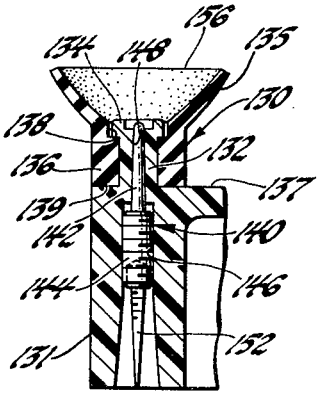
FIG. 7 is an enlarged vertical sectional view of the suction cup and air bleed control arrangement taken substantially on the line 7—7 of FIG. 6.

With reference to FIGS. 3, 6 and 7, there is shown the time delay means of the subject invention in the form of a suction cup structure 130 including a housing 131 of plastic material shown secured to the actuator lefthand leg by suitable means such as by heat welding or the like. As best seen in FIG. 7, the housing 131 includes an integral cylindrical boss 132 formed with an outer head 134. The suction cup structure includes a resilient suction cup 135 having a neck portion 136. A recess 138 of the suction cup is adapted to receive the head 134 with the neck portion 136 enclosing the boss 132 such that its bottom end 139 is snugly seated against the end face 137 of the housing.

Valve means 140 in the form of a tapered valve stem 142 and threaded shank 144 extend through an outer axial bore 146 and reduced tapered or conical bore 148 of the housing. The valve member 140 shank portion 144 is threadably received in the axial bore 146 such as by self threading in longitudinal ribs 152. Thus, threaded movement of shank 144 allows axial adjustment of the valve stem 142 within the tapered bore. By virtue of the above arrangement the valve stem 142 and the tapered bore to define an air bleed passageway having a fine rate of bleed adjustment. The purpose of the air bleed is to destroy the vacuum of the suction cup after a predetermined time interval after the cup is joined together with the forward face of the service area wall portion 154.

Thus, in operation when the actuator 88 is depressed by the operator, the switch arm 120 is moved to its innermost position (FIG. 4) depressing the microswitch plunger 124 and energizing the dispenser 44 to allow immediate dispension of ice pieces into the trough 54 and through the opening 38 of the passageway 59. As the actuator together with the arm member is manually moved axially toward the innermost position of FIG. 4, suction cup face 156 engages the surface 160 of wall portion 154. Upon the actuator arm 120 contacting the switch means depressing its plunger button 124 to the innermost switch closing position, the resilient suction cup 135 is deformed against the wall portion surface 160 to an essentially flattened condition providing a cushioned stop position for the actuator 88.

Figure 5:
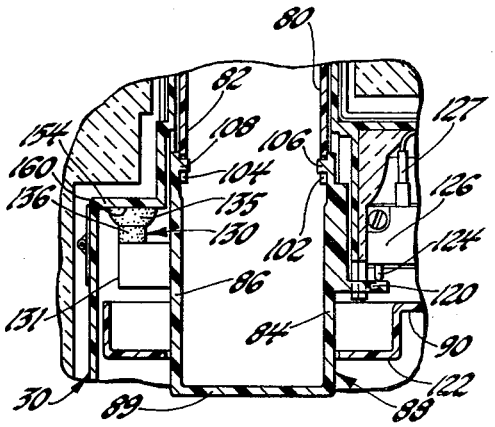
FIG. 5 is a fragmentary portion of FIG. 4 showing the actuator in its released time delay position.

With reference to FIG. 5, it will be seen that upon the manual release of the actuator 88 the suction cup 135 is operative to resiliently return the actuator axially outward from the innermost position of FIG. 4 to its predetermined time delay position of FIG. 5, wherein the actuator is retained by the suction grippin engagement between the suction cup face 156 and surface 160. In this manner the arm member 120 is retracted from its switch contacting position allowing the microswitch 126 to open thereby deenergizing the ice dispensing apparatus 44. It will be appreciated that the actuator is retained in its time delay position for the predetermined time delay period to prevent the closing of the closure member 60 and thereby insure that all the dispensed ice pieces pass through the opening 38 and into the passageway 59.

Upon completion of the time delay period, sufficient air will have entered the suction cup 135 via the air inlet means, in the form of the bleed passageway between counterbore 148 and the valve stem 142. This results in the destruction of the suction in the cup allowing the actuator 88 to return to its biased outer position of FIG. 3 as a result of the closure member being returned to its closed position.

While the embodiment of the invention as herein disclosed constitutes a preferred embodiment, it is to be understood that other forms might be adopted.

The embodiments of the invention in which an exclusive property or privilege is claimed are defined as follows:

1. In an ice piece dispensing apparatus having means defining an opening, closure means normally gravity biased to block said opening against the passage of ice pieces therethrough, an actuator reciprocally operable along its axis of travel for moving said closure means from its biased closed position to an open position permitting ice pieces dispensed from said apparatus to enter said opening, sequentially related switch means and time delay means operated in response to the reciprocal movement of said actuator energizing said apparatus and delaying the closing of the opening by said closure member, respectively; the improvement wherein said switch means being operated by an arm member on said actuator extending transversely relative to said actuator axis of travel, whereby upon said actuator being moved axially to its innermost position said arm member contacts said switch means energizing said apparatus causing ice pieces to be discharged gravitationally through said opening, said time delay means in the form of a suction cup structure positioned on said actuator having a body of resilient material provided with a suction face, said suction face being located in a plane oriented transverse to said actuator axis a predetermined axial distance inwardly relative to said arm member, inlet means in said cup structure providing communication between said cup and the atmosphere permitting the controlled admission of air thereto for destroying the suction in said cup after a predetermined time interval, whereby upon said actuator together with said arm member being manually moved axially toward said innermost position said suction face engages a planar surface on said apparatus such that upon said actuator arm member contacting said switch means at said innermost position said resilient cup being deformed against said planar surface providing a cushioned stop position against said surface and, upon the manual release of said actuator said cup being operative to resiliently return said actuator axially outwardly from said innermost position to a predetermined time delay position retained by the suction gripping engagement between said cup and said surface such that said arm member is retracted from its switch contacting position allowing said switch means to open so as to deenergize said apparatus, said actuator being retained in said time delay position for said predetermined time delay period to prevent the closing of said closure means to insure that all the dispensed ice pieces have passed through said opening, and whereby upon the completion of said time delay period sufficient air has entered said cup via said air inlet means to destroy the suction in said cup allowing said actuator to return to its biased outer position as a result of said closure member being returned to its closed position.

* * * * *